US005733027A

United States Patent [19]

Lautenschläger

[11] Patent Number: 5,733,027

[45] Date of Patent: Mar. 31, 1998

[54] DRAWER WITH ROLLER PULL-OUT GUIDE

[75] Inventor: Horst Lautenschläger, Reinheim, Germany

[73] Assignee: MEPLA-Werke Lautenschläger GmbH & Co. KG, Germany

[21] Appl. No.: 752,534

[22] Filed: Nov. 20, 1996

[30] Foreign Application Priority Data

Dec. 20, 1995 [DE] Germany ..... 195 47 685.9

[51] Int. Cl.[6] ..... A47B 88/00

[52] U.S. Cl. ..... 312/334.12; 312/334.21

[58] Field of Search ..... 312/330.1, 334.4, 312/334.7, 334.1, 334.12, 334.18, 334.19, 334.21, 334.5, 334.8; 384/19, 23

[56] References Cited

U.S. PATENT DOCUMENTS

| | | | |
|---|---|---|---|
| 883,069 | 3/1908 | Yawman | 312/334.12 |
| 917,885 | 4/1909 | Morse | 312/334.12 |
| 2,575,566 | 11/1951 | Shand | 312/334.15 |
| 5,020,868 | 6/1991 | Brunnert | 312/333 X |

FOREIGN PATENT DOCUMENTS

| | | | |
|---|---|---|---|
| 399265B | 4/1995 | Austria . | |
| 702934 | 1/1941 | Germany . | |
| 29507853 | 9/1995 | Germany . | |
| 195282 | 5/1938 | Switzerland | 312/334.12 |

*Primary Examiner*—Peter M. Cuomo
*Assistant Examiner*—Janet M. Wilkens
*Attorney, Agent, or Firm*—Londa and Traub LLP

[57] ABSTRACT

A drawer, which is supported in the carcass of a piece of furniture so that it can be pulled out by means of a roller pull-out guide (10), at the side walls (12) of which drawer, in the rear end region in the interior of the carcass, in each case at least one roller (20) is provided, which is supported rotatably about an axis running horizontally at right angles to the pull-out direction. The roller (20) is capable of rolling on the guide rails, (14), which can be mounted on the respectively assigned carcass wall, the guide rails, in their front end region outside of the carcass, having at least one roller (24) rolling on the roller path (26) of the assigned side wall (12) of the drawer. The roller (20), rotatably supported at the respectively assigned side wall (12) of the drawer, is disposed within the carcass in the end region of a slider component (38) which, in turn, is held at the side wall (12) longitudinally displaceably by a given amount in the pull-out direction between a retracted position and a pulled-out position protruding over the back wall of the drawer in the direction of the rear wall of the carcass.

9 Claims, 1 Drawing Sheet

Fig. 1
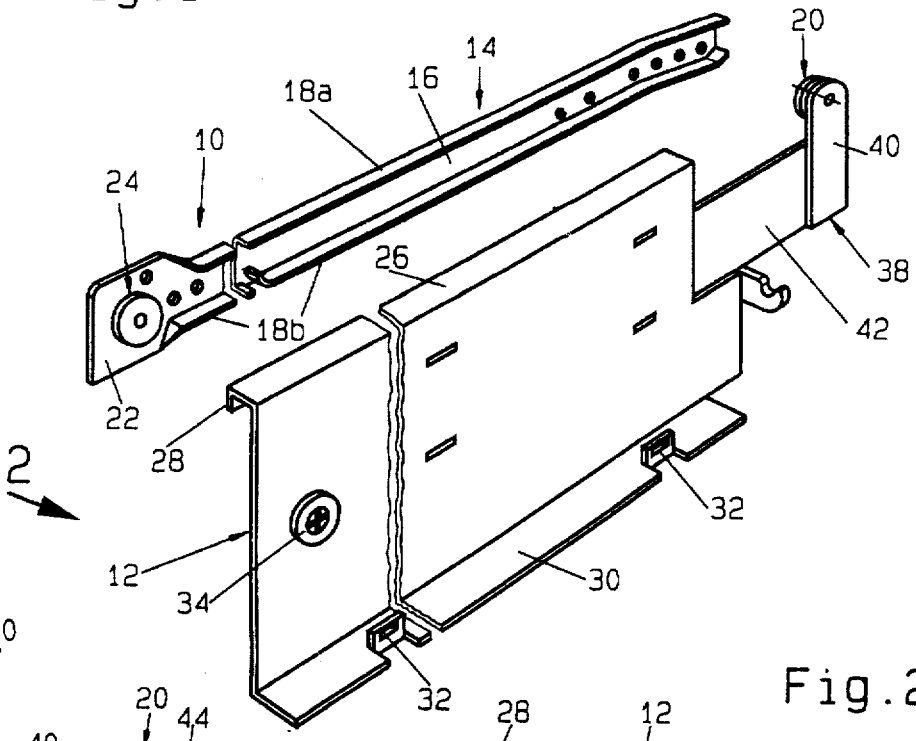
Fig. 2
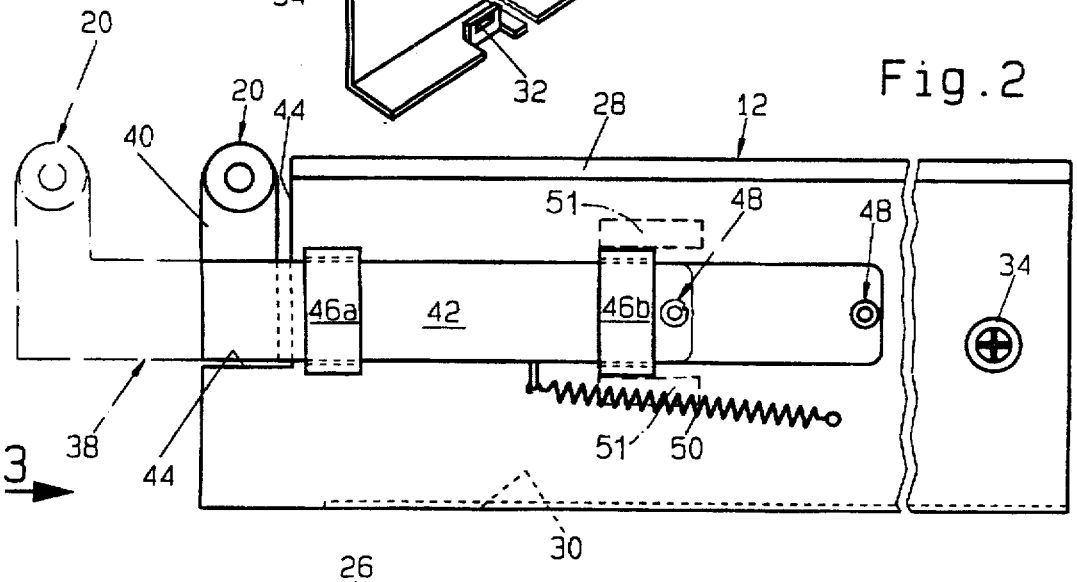
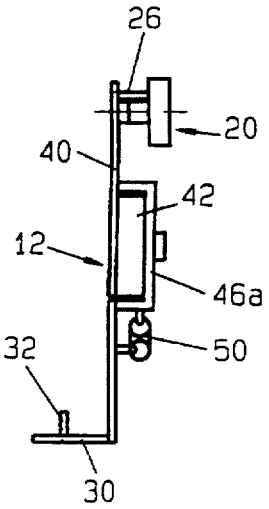
Fig. 3

DRAWER WITH ROLLER PULL-OUT GUIDE

BACKGROUND OF THE INVENTION

The invention relates to a drawer, which is supported in the carcass of a piece of furniture so that it can be pulled out by means of a roller pull-out guide, at the side walls of which drawer, in the rear end region in the interior of the carcass, in each case at least one roller is provided, which is supported rotatably about an axis running horizontally at right angles to the pull-out direction and is capable of rolling on the roller paths provided on guide rails, which can be mounted on the respectively assigned carcass wall, the guide rails, in their front end region outside of the carcass, having at least one roller rolling on the roller path formed on the assigned side wall of the drawer.

Such drawers, at the side walls of which roller paths for the roller pull-out guides are integrated, are known. In particular, in the case of those drawers, for which the drawers are punched out of sheet metal and which have bent side walls, it is possible to form the roller paths for the roller, which is provided at the front end of the guide rail, at the drawer by a strip of material, which is bent over from the upper edge of the side wall of the drawer and is provided with an adjoining cross member, which is bent over downwards. The disadvantage of such simple roller pull-outs lies therein that the drawer can be pulled out only so far out of the interior of the carcass, until the rollers, provided at the rear end of the side walls of the drawer, come up against the rollers provided at the front end of the guide rails attached to the carcass. However, the rear part of the drawer then is still in the carcass of the cabinet, cupboard or wardrobe and this region is not as accessible as it is in the case of drawers with a so-called full pull-out, for which the drawer can be pulled out completely from the carcass.

As a rule, drawers, which can be pulled out fully, require a further, intermediate rail, which is Z-shaped in cross section and provided in turn with rollers, to be interposed. The weight, the technical effort and the costs for such a complete pull-out then increase markedly.

In contrast, it is an object of the invention to develop further the roller pull-out guide of a drawer of the type in question here by means of simple and reasonably priced means so that the drawer, just as a drawer provided with a full pull-out, can be pulled completely out of the interior of the carcass.

SUMMARY OF THE INVENTION

Starting out from a drawer of the initially mentioned type, this objective is accomplished pursuant to the invention owing to the fact that the roller, rotatably supported at the respectively assigned side wall of the drawer, is disposed within the carcass in the end region of a slider component which, in turn, is held at the side wall longitudinally displaceably by a given amount in the pull-out direction between a retracted position and a pulled-out position protruding over the back wall of the drawer in the direction of the rear wall of the carcass. Due to the possibility of shifting the slider into the pulled-out position in which the slider, like the rollers provided on it, lies clearly behind the rear wall of the drawer, it is possible to pull out the drawer further by the length displaceability of the slider.

Advisably, the respective slider component has a bearing plate, which is disposed in a cutout or depression of the side wall open towards the end within the carcass and essentially fits into and fills the cutout or depression and at which the roller is rotatably mounted, and a flat guiding slider, which is held parallel to and lies against the side wall and can be shifted longitudinally at the side wall and is preferably guided on the outside of the respective side wall pointing to the assigned carcass wall, is then joined to the bearing plate.

For holding the guiding slider, at least two guiding shackles, which are spaced apart in the pull-out direction of the drawer and fit around and overlap the guiding slider and which are fastened to the side wall, may be provided.

In order to prevent the possibility that the guiding slider, held in this manner, can be pulled out of the guiding shackles and that the drawer consequently can fall down, it is advisable to provide a stop at the end of the guiding slider averted from the bearing plate. This stop protrudes towards the carcass wall and, in the rearwards pulled-out position, comes to lie against the front guiding shackle.

This stop may be formed by the head of a screw, which is screwed with its short shaft into a threaded borehole in the guiding rail. This has the advantage that the guiding slider, after removal of the screw forming this stop, can readily be dismantled from the side wall of the drawer by pulling out the guiding shackle.

Alternatively the guiding slider can also be guided in an elongated crease of appropriate width and depth in the side wall of the drawer itself, in which case, care must be taken, for example by short tabs overlapping the side of the guiding shackle averted from the side wall, that the guiding shackles cannot emerge from the crease at right angles to the pulling-out direction.

Furthermore of advantage is an embodiment, for which a spring under tension directly or indirectly engages a slider component and puts it under tension in the retracted position, in which the bearing plate is in the cutout of the side wall.

The tension, exerted by the spring on the slider component, advisably is greater than the frictional forces, which tend to hold the pulled-out slider component in the pulled-out position and arise between the slider component and the components holding it movably. With respect to the pull-out path, additionally made available by the slider component, the drawer then is self-closing. If, on the other hand, the usual self-closing mechanism is provided by changing the slope of the guiding rail at its inner end, the drawer as a whole, as it approaches the closed position, is self-closing.

In order to prevent that the drawer, in the fully pulled-out state, automatically closes by the extent to which the slider is pulled out, a locking device may be provided, which holds the slider component in the fully pulled-out position, but is unlocked as the drawer is being closed by a brief pressure on the front face of the drawer, whereupon the tension of the spring, which engages the guiding slider, becomes effective and closes the drawer.

The invention is described in greater detail in the following description of an example in conjunction with the drawing in which

BRIEF DESCRIPTION OF THE DRAWINGS

FIG. 1 shows a perspective view of the side wall of a drawer, constructed in the inventive manner, with the slider component pulled out, as well as of the associated guiding rail, which has been dismounted, FIG. 2 shows the side wall of the drawer, as seen in the direction of arrow 2 in FIG. 1 and FIG. 3 shows a view of the side wall of a drawer as seen in the direction of arrow 3 in FIG. 2.

FIG. 1 shows the interacting parts of a roller pull-out guide 10 for drawers, for which the function of the running rail on the drawer side is integrated in the case shown into the side wall 12 of the drawer, which is produced from metal by a stamping machine method. On the other hand, the guiding rail 14, which is to be mounted on the assigned wall of the carcass, is constructed conventionally. In this case, conventional means that the guiding rail is constructed as a profile rail, which is approximately U-shaped in cross section and is fastened with its cross member surface 16 at the associated carcass wall, with which it is in contact and the profile legs 18*a*, 18*b* of which, which protrude from the cross member surface 16 and are formed by the legs of the U, protrude in the direction of the side wall 12 of the drawer and form roller paths for a roller 20, rotatably mounted at the end of the side wall of the drawer within the carcass. A second roller 24, on which the roller path of the drawer rolls at the side wall 12 of the drawer, is then rotatably supported at the front end of the guiding rail, which is pointing out of the carcass and enlarged to a plane fastening flange 22. In the case shown, this roller path is formed by a strip-shaped profile leg 26, which is angled at approximately right angles from the upper edge of the side wall of the drawer and from the edge of which, averted from the side wall, a low, strip-shaped profile leg 28 is bent over downwards and, on the one hand, embraces the roller 24 of the supporting rail on the side averted from the side and, on the other, stiffens and stabilizes on the whole the upper edge of the side wall of the drawer.

From the lower edge of the side wall 12 of the drawer, another strip-shaped profile leg 30 is bent over at right angles in the opposite direction, that is, away from the assigned carcass wall and, aside from stiffening the side wall 12, at the same time functions as a support for the bottom of the drawer, which is not shown. Tabs 32, cut out of this profile leg 30 and bent up, engage a groove or a recess in the bottom of the drawer and fix the bottom of the drawer on the profile leg 30. In the outer end region of the side wall 12 of the drawer, external to the carcass, and approximately half-way up the side wall part 34 of a metal connecting fitting is disposed, to which a second metal fitting, which is not shown, can be fastened and which protrudes from the inner surface of an assigned front face of the drawer. To the extent described so far, the roller pull-out guide is known.

In a modification from the state of the art, the roller 20 is not mounted rotatably directly at the side wall 12 of the drawer but is mounted on a slider component 38, which is held longitudinally displaceably in the pull-out direction of the drawer and, moreover, between a retracted first position, in which the position of the roller 20 corresponds to the position of such rollers at the side wall 12 of conventional roller pull-out guides, and a position, shown in FIG. 1 and additionally shown by lines of dots and dashes in FIG. 2, in which the roller 20 is pulled out protruding over the rear wall of the drawer in the direction of the rear wall of the carcass.

The slider component 38 is composed in the case shown of a bearing plate 40 and a flat, elongated guiding slider 42, which is fastened to the bearing plate and is held longitudinally displaceably at and parallel to the side wall 12. This bearing plate 40, in turn, in the first retracted position, is in a cutout 44 of the side wall 12 of the drawer, which is open towards the end within the carcass and towards the top and is dimensioned so that it fills up this cutout in the retracted position of the slider component 38. The cutout can also be replaced by a depression, which is open towards the rear wall of the carcass and suitably accommodates the bearing plate in the retracted position. If the bearing plate 40 is disposed offset parallel to the plane of the side wall at the guiding slider 42, the cutout 44 or the depression can also be omitted.

The flat, elongated guiding slider 42 is held in contact with the outside of the side wall 12 facing the carcass wall. It is guided by at least two guiding shackles 46*a*, 46*b*, which are at a distance from one another in the pulling-out direction of the drawer, overlap fittingly the guiding slider 42 and are fastened to the side wall. At the front end of the guiding slider averted from the bearing plate, a stop in the form of the head of a screw 48, screwed into a threaded borehole in the guiding slider 42, which prevents the guiding slider 42 and, with that, the slider component 38 as a whole being pulled out unintentionally from the guiding shackles 46*b*, 46*a*. However, the screw 48 can be screwed out for the assembly and a possible disassembly of the slider component.

By means of an elongated spring 50 under tensile tension, connected on the one hand to the guiding slider 42 and, on the other, to the side wall 12 of the drawer, the slider component 38 is pre-stressed into the retracted position. However, the prestressing of the spring is only of such a magnitude, that it overcomes the friction between the guiding slider 42 and the guiding shackles 46*a*, 46*b* holding it but does not offer much resistance to a pull-out force deliberately exerted on the drawer, so that the additional pull-out path, made available by the slider component, can be realized by the person pulling out the drawer without effort.

Between the slider component and the side wall of the drawer, it may be appropriate to provide a locking device 51, which becomes effective in the fully drawn-out position of the slider component and prevents a drawer, which is fully pulled out, being pulled in automatically under the influence of the tension on the spring 50 by the amount by which the slider component 38 is displaced. When the drawer is closed by being pushed into the interior of the carcass, the locking device can then be unlocked by a brief pressure in the pushing-in direction when the roller 20 encounters the end stops of the guide rail 14. The spring 50 then pushes the drawer into the completely closed position.

It is evident that modifications and further developments of the example described can be realized within the scope of the inventive concept. For example, the way in which the guiding slider 42 is supported can also be realized in a different manner. Instead of the guiding shackles 46*a*, 46*b* described, the guide for the guiding slider 42 can also be integrated in the side wall of the drawer by molding a fitting crease. Appropriate friction-reducing measures can be taken to reduce the frictional forces arising between the guiding slider 42 and its holding mechanism. Consideration can be given here to an appropriate treatment of the surfaces sliding on top of one another by polishing them or by coating them with friction-lowering plastics or also supporting the guiding slider in rollers.

What is claimed is:

1. A drawer, which is supportable in a carcass of a piece of furniture by means of a roller pull-out guide, the drawer comprising:

first and second side walls and a rear wall, and at least one roller provided on a rearward portion of a first side wall of the drawer, the at least one roller being supported rotatably about an axis running horizontally at right angles to a pull-out direction of the drawer for rolling on a roller path of a pull-out guide in an installed position, the at least one roller being disposed on a free end region of a slider component, said slider component being retained adjacent the first side wall, and being longitudinally displaceable with respect to the first side wall to a set distance in the pull-out direction between a retracted position and a pulled-out position, in which pull-out position the free end region Of the slider component and the at least one roller protrude longitudinally past the rear wall of the drawer in a rearward direction wherein the slider component comprises a flat guiding slider retained longitudinally parallel to and adjacent a face of the first side wall and being slidable in relation thereto, and a bearing plate attached to a rearward portion of the flat guiding slider, the roller being attached to the bearing plate, the first side wall being formed with a receiving means in a rearward portion thereof conforming generally in shape to the bearing plate, for receiving the bearing plate therein when the slider component is in the retracted position.

2. The drawer of claim 1, wherein the receiving means is formed as a cut-out or depression opening in the rearward direction of the first side wall.

3. The drawer of claim 2, wherein the guiding slider is guidingly retained on an outside face of the first side wall.

4. The drawer of claim 3, wherein the guiding slider is retained by at least two guiding shackles attached to the drawer, which shackles are spaced apart in the longitudinal direction of the drawer and fit around and laterally overlap the guiding slider.

5. The drawer of claim 4, wherein the guiding slider has a stop means adjacent an end of the slider opposite the free end, which stop means protrudes laterally towards the outside of the first side wall, and in the pulled-out position of the slider, abuts against a forwardmost of said at least two guiding shackles.

6. The drawer of claim 5, wherein the stop means is formed by the head of a screw, which is retainingly screwed by way of a shaft thereof into a correspondingly threaded borehole in the guiding slider.

7. The drawer of claim 1, wherein the slider component is biased towards a retracted position by way of a biasing means.

8. The drawer of claim 7, wherein the biasing force exerted by the biasing means on the slider component is greater than a frictional force acting on the slider component against the biased direction.

9. The drawer of claim 7, further comprising a locking means holding the slider component in a completely pulled-out position.

* * * * *